US012490767B2

(12) United States Patent
Jang et al.

(10) Patent No.: US 12,490,767 B2
(45) **Date of Patent: *Dec. 9, 2025**

(54) AEROSOL GENERATION SYSTEM

(71) Applicant: KT&G CORPORATION, Daejeon (KR)

(72) Inventors: Yong Joon Jang, Daejeon (KR); Gyoung Min Go, Daejeon (KR); Jang Won Seo, Daejeon (KR); Jin Chul Jung, Seoul (KR); Jong Seong Jeong, Suwon-si (KR); Chul Ho Jang, Bucheon-si (KR)

(73) Assignee: KT&G CORPORATION, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/500,154

(22) Filed: Nov. 2, 2023

(65) Prior Publication Data

US 2024/0057661 A1 Feb. 22, 2024

Related U.S. Application Data

(63) Continuation of application No. 16/966,399, filed as application No. PCT/KR2019/000739 on Jan. 18, 2019, now Pat. No. 11,839,233.

(30) Foreign Application Priority Data

Jan. 31, 2018 (KR) ..... 10-2018-0012459

(51) Int. Cl.
*A24F 40/48* (2020.01)
*A24D 1/20* (2020.01)
(Continued)

(52) U.S. Cl.
CPC ..... *A24D 1/20* (2020.01); *A24F 40/42* (2020.01); *A24F 40/46* (2020.01); *A24F 40/48* (2020.01); *A24F 40/57* (2020.01)

(58) Field of Classification Search
CPC ..... A24F 40/20; A24F 40/46; A24F 40/40; A24F 40/50; A24F 40/57; A24F 40/51; A24F 40/10; A24F 40/465; A24F 40/42
See application file for complete search history.

(56) References Cited

U.S. PATENT DOCUMENTS 5,052,412 A 10/1991 Green et al.
5,224,498 A 7/1993 Deevi et al.
(Continued)

FOREIGN PATENT DOCUMENTS

CN 103355742 A 10/2013
CN 103974640 A 8/2014
(Continued)

OTHER PUBLICATIONS

Communication dated Oct. 31, 2024 in European Application No. 19 747 366.3.
(Continued)

*Primary Examiner* — Truc T Nguyen
(74) *Attorney, Agent, or Firm* — Sughrue Mion, PLLC

(57) ABSTRACT

An aerosol generation system includes a tobacco medium accommodation portion and a moisturizer accommodation portion located at an upstream end or a downstream end of the tobacco medium accommodation portion. In addition, an aerosol generation system includes an aerosol generation device including an elongated cavity for accommodating the cigarette, a first heater for heating the tobacco medium accommodation portion, and a second heater for heating the moisturizer accommodation portion.

11 Claims, 12 Drawing Sheets

(51) Int. Cl.

| | |
|---|---|
| ***A24F 40/42*** | (2020.01) |
| ***A24F 40/46*** | (2020.01) |
| *A24F 40/57* | (2020.01) |

(56) References Cited

U.S. PATENT DOCUMENTS

| | | | | |
|---|---|---|---|---|
| 5,622,190 | A * | 4/1997 | Arterbery | A24D 3/06 131/345 |
| 6,796,312 | B2 * | 9/2004 | Eichel | A24D 3/12 131/202 |
| 9,516,899 | B2 | 12/2016 | Plojoux et al. | |
| 10,039,890 | B2 | 8/2018 | Chida et al. | |
| 10,548,350 | B2 | 2/2020 | Greim et al. | |
| 10,820,623 | B2 | 11/2020 | Grant | |
| 11,013,872 | B2 | 5/2021 | Silvestrini et al. | |
| 11,039,644 | B2 | 6/2021 | Paprocki et al. | |
| 2005/0166933 | A1 | 8/2005 | Lesser et al. | |
| 2005/0211260 | A1 | 9/2005 | Sasaki et al. | |
| 2007/0169785 | A1 | 7/2007 | Gedevanishvili et al. | |
| 2008/0230076 | A1 * | 9/2008 | Wick | B01J 20/3253 131/345 |
| 2011/0036366 | A1 * | 2/2011 | Sebastian | A24D 3/08 131/342 |
| 2011/0126848 | A1 | 6/2011 | Zuber et al. | |
| 2011/0271968 | A1 * | 11/2011 | Carpenter | A24D 3/048 131/342 |
| 2012/0000481 | A1 * | 1/2012 | Potter | A24D 3/068 131/331 |
| 2012/0118309 | A1 | 5/2012 | Taniguchi | |
| 2013/0292279 | A1 * | 11/2013 | Bengtsson | B65D 85/10 206/245 |
| 2014/0305449 | A1 | 10/2014 | Plojoux et al. | |
| 2014/0363145 | A1 | 12/2014 | Plojoux et al. | |
| 2015/0208729 | A1 | 7/2015 | Monsees et al. | |
| 2015/0272226 | A1 | 10/2015 | Zuber et al. | |
| 2016/0022930 | A1 | 1/2016 | Greim et al. | |
| 2016/0360785 | A1 | 12/2016 | Bless et al. | |
| 2017/0055582 | A1 | 3/2017 | Blandino et al. | |
| 2017/0303588 | A1 | 10/2017 | Batisa | |
| 2022/0001120 | A1 | 1/2022 | Ballesteros Gomez et al. | |
| 2022/0256914 | A1 | 8/2022 | Kim et al. | |
| 2022/0400749 | A1 | 12/2022 | Park et al. | |
| 2023/0077221 | A1 | 3/2023 | Park et al. | |
| 2025/0072483 | A1 * | 3/2025 | Ahn | A24D 3/048 |
| 2025/0072522 | A1 * | 3/2025 | Moon | A24F 40/57 |

FOREIGN PATENT DOCUMENTS

| | | | | |
|---|---|---|---|---|
| CN | 104135881 | A | 11/2014 | |
| CN | 104994757 | A | 10/2015 | |
| CN | 105682488 | A | 6/2016 | |
| CN | 105792688 | A | 7/2016 | |
| CN | 107536100 | A | 1/2018 | |
| CN | 109496129 | A | 3/2019 | |
| EP | 0777977 | * | 6/1997 | A24D 3/08 |
| EP | 3689162 | A1 | 8/2020 | |
| JP | WO 2003056949 | * | 5/2005 | A24F 42/10 |
| JP | 2012-102250 | A | 5/2012 | |
| JP | WO2012/023515 | A1 | 10/2013 | |
| JP | 2014-521562 | A | 8/2014 | |
| JP | 2015-506170 | A | 3/2015 | |
| KR | 10-2005-0083035 | A | 8/2005 | |
| KR | 10-0617983 | B1 | 8/2006 | |
| KR | 10-0641726 | B1 | 10/2006 | |
| KR | 10-0844445 | B1 | 7/2008 | |
| KR | 10-2012-0104533 | A | 9/2012 | |
| KR | 10-2014-0116055 | A | 10/2014 | |
| KR | 10-2017-0058918 | A | 5/2017 | |
| RU | 2 254 790 | C2 | 6/2005 | |
| RU | 2 602 053 | C2 | 11/2016 | |
| WO | 2006/097447 | A1 | 9/2006 | |
| WO | 2010113702 | A1 | 10/2010 | |
| WO | 2012/164247 | A1 | 12/2012 | |
| WO | 2013/098395 | A1 | 7/2013 | |
| WO | 2013/102609 | A2 | 7/2013 | |
| WO | WO 2013076098 | * | 7/2014 | A24F 40/42 |
| WO | 2014/140320 | A1 | 9/2014 | |
| WO | 2015/062983 | A2 | 5/2015 | |
| WO | 2015/091258 | A1 | 6/2015 | |
| WO | 2016/207407 | A1 | 12/2016 | |
| WO | 2017/013164 | A1 | 1/2017 | |
| WO | 2017/036954 | A1 | 3/2017 | |
| WO | 2017/194769 | A1 | 11/2017 | |
| WO | 2017/211600 | A1 | 12/2017 | |
| WO | 2017/216671 | A1 | 12/2017 | |

OTHER PUBLICATIONS

Communication issued Mar. 25, 2025 in Chinese Application No. 202210473435.2.

Communication dated Jan. 11, 2023 from the European Patent Office in EP Application No. 19747366.3.

Communication issued Sep. 8, 2021 from the Chinese Patent Office in Chinese Application No. 201980010110.7.

Decision on Grant of a Patent for Invention dated Feb. 15, 2021 from the Federal Service for Intellectual Property of Russia in RU Application No. 2020128381/03.

Extended European Search Report dated Aug. 20, 2021 from the European Patent Office in European Application No. 19747366.3.

Office Action dated Jul. 13, 2021 issued by the Japanese Patent Office in Japanese Application No. 2020-541572.

Office Action dated Jul. 25, 2022, issued in Canadian Application No. 3,090,072.

Office Action dated Mar. 7, 2023 from the Japanese Patent Office in JP Application No. 2022-034239.

Office Action dated May 6, 2021 issued by the Korean Patent Office in Korean Application No. 10-2020- 0056159.

Office Action issued on Dec. 7, 2021 in Canadian Application No. 3090072.

Notice of Allowance issued in parent U.S. Appl. No. 16/966,399 mailed Aug. 2, 2023.

International Search Report for PCT/KR2019/000739 dated Apr. 22, 2019 [PCT/ISA/210].

Written Opinion for PCT/KR2019/000739 dated Apr. 22, 2019 [PCT/ISA/237].

Chinese Office Action dated Aug. 28, 2025, issued in Chinese application No. 202210473435.2.

* cited by examiner

AEROSOL GENERATION SYSTEM

CROSS REFERENCE TO RELATED APPLICATIONS

This application is a continuation of U.S. application Ser. No. 16/966,399 filed on Jul. 30, 2020, which is a National Stage of International Application No. PCT/KR2019/000739 filed Jan. 18, 2019, claiming priority based on Korean Patent Application No. 10-2018-0012459 filed Jan. 31, 2018.

TECHNICAL FIELD

The present disclosure relates to an aerosol generation system.

BACKGROUND ART

In recent years, the demand for alternative methods of overcoming shortcomings of traditional cigarettes has increased. For example, there is growing demand for a method of generating an aerosol by heating an aerosol generating material in a cigarette, rather than by combusting a cigarette.

In general, a slurry reconstituted tobacco sheet, which is a main raw material of a tobacco medium, has weak tensile force, and thus, it is difficult form slurry reconstituted tobacco sheets into a cigarette. Also, the tobacco medium contains a large amount of moisturizer, which makes the tobacco medium physically weak. In addition, a tobacco medium containing moisturizer is sensitive to humidity of a surrounding environment due to hydrophilicity thereof, and thus, it is difficult to control the air-conditioning environment in manufacture. There is also a limit to the amount of moisturizer that may be contained in a tobacco medium.

When moisturizer is contained in a separate cartridge in addition to a tobacco medium, there are difficulties (expiration date, deterioration, and so on) in terms of the maintenance. Also, condensation may occur in the flowing path of aerosol generated in the cartridge, thereby causing contamination.

In this regard, research on a heating-type cigarette and a heating-type aerosol generation device is actively being conducted.

DESCRIPTION OF EMBODIMENTS

Technical Problem

An aerosol generation system is provided. An aerosol generation system may include a cigarette and an aerosol generation device. In particular, a cigarette may include a tobacco medium accommodation portion and a moisturizer accommodation portion, and an aerosol generation device may include a first heater for heating the tobacco medium accommodation portion and a second heater for heating the moisturizer accommodation portion.

Technical problems to be solved by the present embodiment are not limited to the technical problems described above, and other technical problems may be inferred from the following embodiments.

Solution to Problem

An aerosol generation system includes a cigarette including a tobacco medium accommodation portion, and a moisturizer accommodation portion located at one of an upstream end and a downstream end of the tobacco medium accommodation portion In addition, an aerosol generation system includes a cigarette including a tobacco medium accommodation portion, and a moisturizer accommodation portion located at one of an upstream end and a downstream end of the tobacco medium accommodation portion.

Advantageous Effects of Disclosure

In the embodiments, a cigarette includes a moisturizer accommodation portion separately from a tobacco medium accommodation portion, and thus, an operating temperature of a first heater for heating the tobacco medium accommodation portion and an operation temperature of a second heater for heating the moisturizer accommodation portion may be lowered.

BEST MODE

Figure 1A:
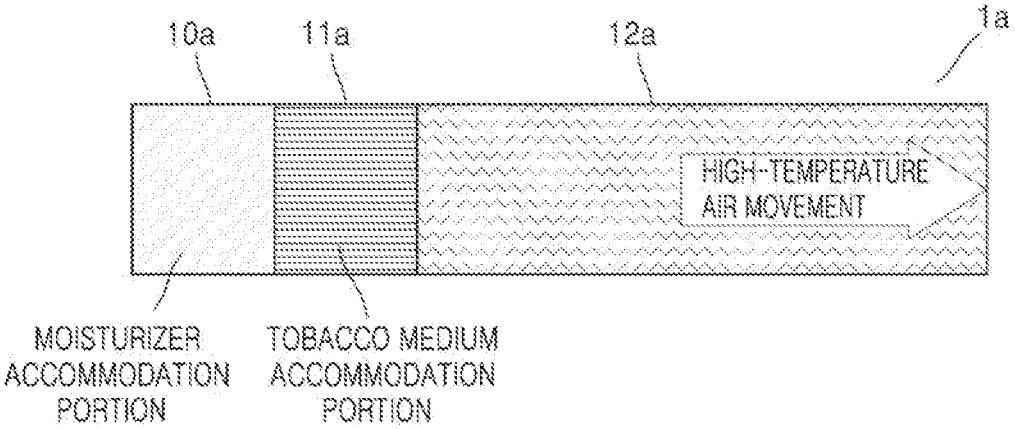
FIGS. 1A to 1B are views illustrating segments constituting a cigarette according to one embodiment.

As a technical device for solving the above-described technical problems, a first aspect of the present disclosure may provide an aerosol generation system including a cigarette including a tobacco medium accommodation portion, and a moisturizer accommodation portion located at one of an upstream end and a downstream end of the tobacco medium accommodation portion; and an aerosol generation device including an elongated cavity for accommodating the cigarette, a first heater for heating the tobacco medium accommodation portion, and a second heater for heating the moisturizer accommodation portion.

In addition, the moisturizer accommodation portion may have any one of a porous matrix structure, a tube structure, a paper tube structure, and a cavity structure.

In addition, the moisturizer accommodation portion may be located at the upstream end of the tobacco medium accommodation portion and has a honeycomb structure.

In addition, moisturizer may be impregnated in the moisturizer accommodation portion having one of the porous matrix structure, the tube structure, and the honeycomb structure, or coated on the moisturizer accommodation portion having one of the paper tube structure and the cavity structure.

In addition, the second heater may have a cylindrical structure arranged to surround at least part of the moisturizer accommodation portion located at the downstream end of the tobacco medium accommodation portion. Otherwise, the moisturizer accommodation portion may be located at the upstream end of the tobacco medium accommodation portion, and the second heater may have one of a cylindrical structure arranged to surround at least part of the moisturizer accommodation portion, a planar structure arranged to be located at an upstream end of the cigarette, an elongated structure arranged to be inserted into the moisturizer accommodation portion, and a structure formed by a combination thereof.

In addition, the first heater may operate to heat the tobacco medium accommodation portion in a first temperature range so that nicotine contained in the tobacco medium accommodation portion is aerosolized, and the second heater may operate to heat the moisturizer accommodation portion in a second temperature range higher than the first temperature range.

In addition, the moisturizer accommodation portion may be wrapped by aluminum foil located inside cigarette paper.

A second aspect of the present disclosure may provide an aerosol generation device including an elongated cavity for accommodating a cigarette; a first heater for heating a tobacco medium accommodation portion of the cigarette; and a second heater for heating a moisturizer accommodation portion of the cigarette.

In addition, the moisturizer accommodation portion may be located at the downstream end of the tobacco medium accommodation portion, and the second heater may have a cylindrical structure arranged to surround at least part of the moisturizer accommodation portion. Otherwise, the moisturizer accommodation portion may be located at the upstream end of the tobacco medium accommodation portion, and the second heater may have one of a cylindrical structure arranged to surround at least part of the moisturizer accommodation portion, a planar structure arranged to be located at an upstream end of the cigarette, an elongated structure arranged to be inserted into the moisturizer accommodation portion, and a structure formed by a combination thereof.

In addition, the first heater may operate to heat the tobacco medium accommodation portion in a first temperature range so that nicotine contained in the tobacco medium accommodation portion is aerosolized, and the second heater may operate to heat the moisturizer accommodation portion in a second temperature range higher than the first temperature range.

MODE OF DISCLOSURE

The present disclosure may be variously changed and have various embodiments, and thus, specific embodiments will be illustrated in the drawings and described in detail in the detailed description. Effects and features of the present disclosure and methods for achieving the effects and features will be clarified by embodiments described below in detail with reference to the drawings. However, the present disclosure is not limited to the embodiments disclosed below and may be implemented in various forms.

In the following embodiments, a singular expression includes plural expressions unless the context clearly indicates otherwise.

In the following examples, terms such as "include/contain" or "have" mean that features or configuration elements described in the specification exist and do not preclude a possibility of adding one or more other features or configuration elements in advance.

In the following examples, terms "upstream" and "downstream" are used to indicate relative positions of segments constituting a cigarette, based on a direction in which a user inhales air by using the cigarette. A cigarette includes a downstream end (that is, a portion into which air flows) and an upstream end (that is, a portion from which air flows out) opposite to the downstream end. When using a cigarette, a user may bite a downstream end of the cigarette. A downstream end may be located downstream an upstream end, while a term "end" may also be described as an "end portion".

In the drawings, sizes of configuration elements may be exaggerated or reduced for the sake of convenient description. For example, sizes and thicknesses of respective configuration elements illustrated in the drawings are randomly illustrated for the sake of convenient description, and thus, the present disclosure is not limited to the illustration.

Hereinafter, the present disclosure will now be described more fully with reference to the accompanying drawings, in which exemplary embodiments of the present disclosure are shown such that one of ordinary skill in the art may easily work the present disclosure. The present disclosure may, however, be embodied in many different forms and should not be construed as being limited to the embodiments set forth herein.

Figure 1B:
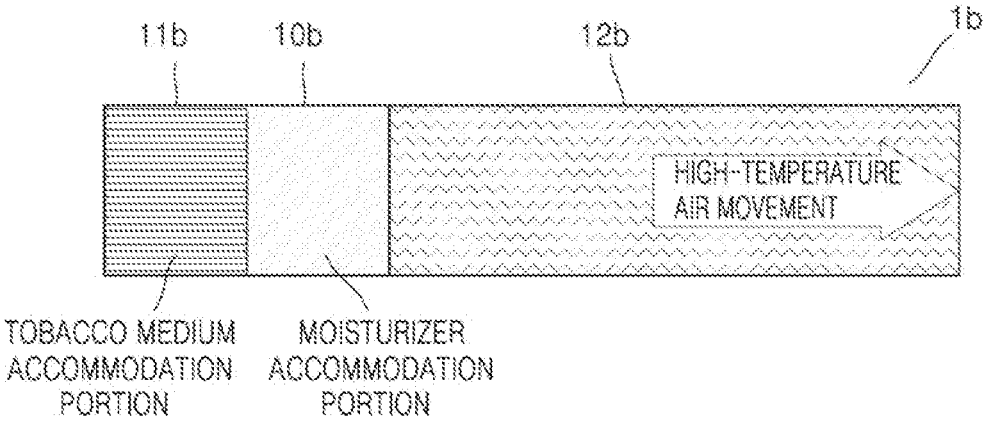

FIGS. 1A to 1B are views illustrating segments constituting cigarettes according to an embodiment.

Referring to FIGS. 1A to 1B, cigarettes 1*a* and 1*b* may include moisturizer accommodation portions 10*a* and 10*b*, tobacco medium accommodation portions 11*a* and 11*b*, and filters 12*a* and 12*b*. Furthermore, although not illustrated in FIG. 1, the cigarettes 1*a* and 1*b* may be wrapped by at least one wrapper.

The moisturizer accommodation portions 10*a* and 10*b* may contain moisturizer. The moisturizer may include glycerin, propylene glycol (PG), and water. The moisturizer may further include at least one of ethylene glycol, dipropylene glycol, diethylene glycol, triethylene glycol, tetraethylene glycol and oleyl alcohol. In addition, the moisturizer accommodation portions 10*a* and 10*b* may further contain nicotine. However, materials contained in the moisturizer accommodation portions 10*a* and 10*b* are not limited thereto.

The moisturizer accommodation portions 10*a* and 10*b* may include wrappers wrapping the moisturizer accommodation portions. In addition, the moisturizer accommodation portions 10*a* and 10*b* may further include materials (for example, aluminum foil) having waterproof, water-repellent (oil-repellent), and heat-resistant characteristics which wrap the moisturizer accommodation portions. In this case, the aluminum foil may be located between the wrappers and the moisturizer accommodation portions 10*a* and 10*b*. Moisturizer contained in the moisturizer accommodation portions 10*a* and 10*b* may leak and contaminate the wrappers, and thus, aluminum foil wrapping the moisturizer accommodation portions 10*a* and 10*b* may be further included to prevent this.

The moisturizer contained in the moisturizer accommodation portions 10*a* and 10*b* may maintain moisture in aerosol, which is generated when the cigarettes 1*a* and 1*b* are heated at an appropriate level, to soften tastes of the cigarettes and enrich atomization amounts thereof.

The tobacco medium accommodation portions 11*a* and 11*b* may include a tobacco medium and a tobacco wrapper wrapping the tobacco medium. The tobacco medium accommodation portions 11*a* and 11*b* may have a cylindrical shape, and the smoke and/or aerosol may be generated from the tobacco medium. The generated smoke and/or aerosol may be inhaled to a user through the filters 12*a* and 12*b*.

The tobacco medium accommodation portion 11*a* and 11*b* may contain a solid material including tobacco raw materials such as reconstituted tobacco sheet, cut tobacco, and reconstituted tobacco. In one embodiment, the tobacco medium accommodation portion 11*a* and 11*b* may be filled with a reconstituted tobacco sheet. The reconstituted tobacco sheet may be corrugated by being wound in a substantially transverse direction on a cylindrical shaft, folded, compressed, or contracted. Porosity may be determined by adjusting a distance between grooves and so on of the corrugated reconstituted tobacco sheet.

In another embodiment, the tobacco medium accommodation portion 11*a* and 11*b* may be filled with tobacco cuts. Here, the tobacco cuts may be made by finely cutting a tobacco sheet (or a slurry reconstituted tobacco sheet). In addition, the tobacco medium accommodation portions 11*a* and 11*b* may be made by combining a plurality of tobacco strands in the same direction (in parallel) or randomly. Specifically, the tobacco medium accommodation portions 11*a* and 11*b* may be made by combining a plurality of tobacco strands, and a plurality of longitudinal channels through which aerosol may pass may be formed. At this time, the longitudinal channels may be uniform or non-uniform depending on sizes and arrangement of the tobacco strands.

The tobacco media of the tobacco medium accommodation portions 11*a* and 11*b* may contain at least one of ethylene glycol, dipropylene glycol, diethylene glycol, triethylene glycol, tetraethylene glycol, and oleyl alcohol. In addition, the tobacco media may further contain glycerin and propylene glycol.

In addition, the tobacco medium accommodation portions 11*a* and 11*b* may contain other additives such as savoring agents and/or organic acid. For example, the savoring agent may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, coriander, coffee, or so on. Furthermore, the tobacco medium accommodation portions 11*a* and 11*b* may also contain some of glycerin or propylene glycol.

The filters 12*a* and 12*b* may be composed of at least one segment and may include a tobacco filter wrapper wrapping the at least one segment. In an embodiment, the filters 12*a* and 12*b* may include at least one of a tube filter, a cooling structure, and a recess filter. The tube filter has a shape including a hollow therein. The tube filter and the recess filter may be made of a cellulose-based material (for example, paper, acetate, and so on), and the cooling structure may be made of pure polylactic acid or a combination of other degradable polymers and polylactic acid.

Furthermore, in FIGS. 1A to 1B, the filters 12*a* and 12*b* are illustrated as being in contact with upstream ends or downstream ends of the tobacco medium accommodation portions 11*a* and 11*b*, but some segments constituting the filters 12*a* and 12*b* may be located between the moisturizer accommodation portions 10*a* and 10*b* and the tobacco medium accommodation portions 11*a* and 11*b*.

In FIG. 1A, the moisturizer accommodation portion 10*a* is located at an upstream end of the tobacco medium accommodation portion 11*a*, and in FIG. 1B, the moisturizer accommodation portion 10*b* is located at a downstream end of the tobacco medium accommodation portion 11*b*. In one embodiment, a plurality of heaters may be used to individually heat the moisturizer accommodation portions 10*a* and 10*b* and the tobacco medium accommodation portions 11*a* and 11*b*. In this case, heating temperatures of the moisturizer accommodation portions 10*a* and 10*b* may be different from heating temperatures of the tobacco medium accommodation portions 11*a* and 11*b*.

When the moisturizer accommodation portion 10*b* is located at a downstream end of the tobacco medium accommodation portion 11*b* as illustrated in FIG. 1B, a heating temperature of the moisturizer accommodation portion 10*b* may be a predetermined temperature for aerosolizing glycerin. Furthermore, when the moisturizer accommodation portion 10*a* is located at an upstream end of the tobacco medium accommodation portion 11*a* as illustrated in FIG. 1A, a high-temperature aerosol generated in the tobacco medium accommodation portion 11*a* passes through the moisturizer accommodation portion 10*a*, and thus, a heating temperature of the moisturizer accommodation portion 10*a* may be lower than the predetermined temperature in FIG. 1B.

Figure 2:
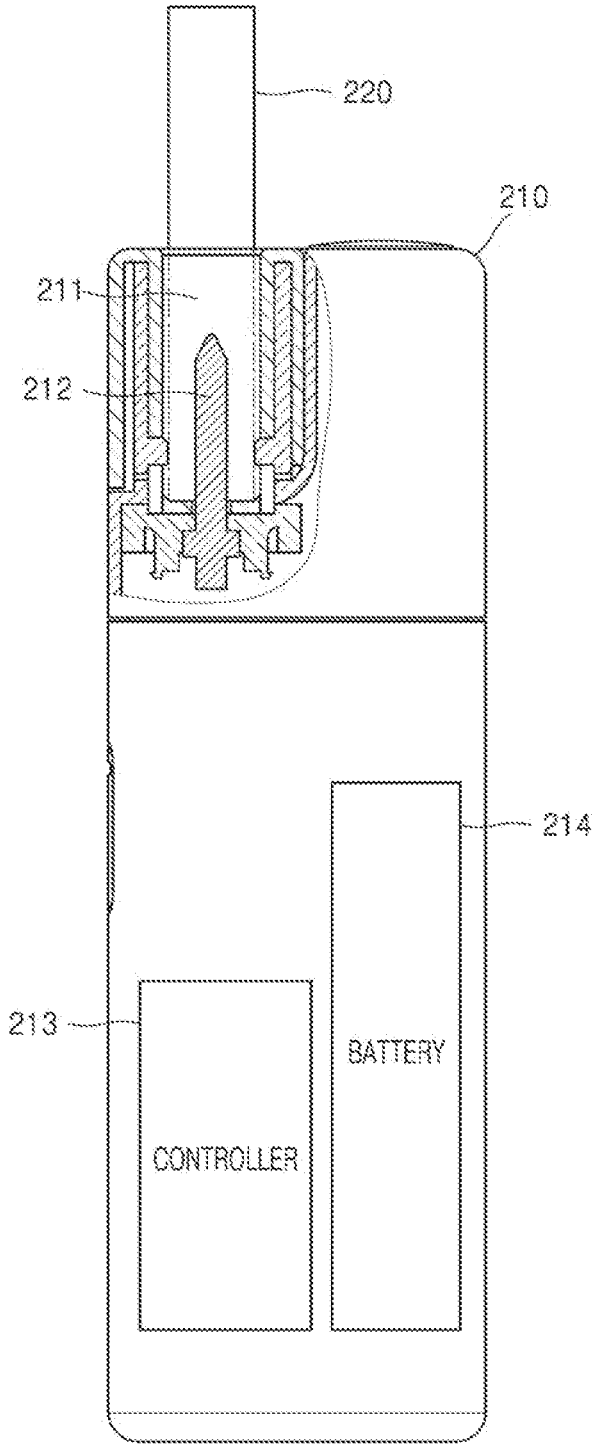
FIG. 2 is a view illustrating an aerosol generation system according to one embodiment.

FIG. 2 is a view illustrating an aerosol generation system according to one embodiment.

Referring to FIG. 2, an aerosol generation system may include an aerosol generation device 210 and a cigarette 220. The cigarette 220 may include a moisturizer accommodation portion, a tobacco medium accommodation portion, and a filter. The cigarette 220 may be the same as the cigarette 1*a* or 1*b* described with reference to FIG. 1A or 1B, and thus, description thereof will be omitted.

The aerosol generation device 210 may include a heater 212, a controller 213, and a battery 214. In addition, the aerosol generation device 210 may include an elongated cavity 211 for accommodating the cigarette 220.

FIG. 2 only shows certain elements of the aerosol generation device 210 which are related to the present embodiment. Therefore, it may be understood by those skilled in the art related to the present embodiment that other general-purpose elements other than the elements illustrated in FIG. 2 may be further included in the aerosol generation device 210.

If the cigarette 220 is inserted into the aerosol generation device 210, the aerosol generation device 210 heats the heater 212. A temperature of a tobacco medium in the cigarette 220 is increased by the heated heater 212, and accordingly, aerosol is generated from the tobacco medium. The generated aerosol is transferred to a user through a filter of the cigarette 220.

The battery 214 supplies power used to operate the aerosol generation device 210. For example, the battery 214 may supply power so that the heater 212 may be heated and may supply power necessary for the controller 213 to operate. In addition, the battery 214 may supply power necessary for a display, a sensor, and a motor installed in the aerosol generation device 210 to operate.

Furthermore, the battery 214 may be a lithium iron phosphate (LiFePO4) or a lithium ion (Li-ion) battery but is not limited to the above-described example. For example, the battery 214 may be a lithium cobalt oxide (LiCoO2) battery, a lithium titanate battery, or the like.

The heater 212 is heated by power supplied from the battery 214. When the cigarette 220 is inserted into the aerosol generation device 210, the heated heater 212 increases a temperature of a tobacco medium in the cigarette 220, and thus, aerosol is generated.

Referring to FIG. 2, the heater 212 may have an elongated structure so that it may be inserted into the cigarette 220. That is, when the cigarette 220 is inserted into the elongate cavity 211, the heater 212 of an elongated structure is located inside the cigarette 220. The heater 212 may be a blade type or a probe type. A probe type may include a cone coupled to a cylinder. The heater 212 may include a plurality of blades or a plurality of probes. Furthermore, the heater 212 may include an electrically conductive track, in which case the electrically conductive track may be disposed along a surface of a blade type substrate or a probe type substrate.

In another embodiment, a heater of the aerosol generation device 210 may have a cylindrical structure partially surrounding the cigarette 220. The heater may be disposed to heat the moisturizer accommodation portion and the tobacco medium accommodation portion of the cigarette 220 by surrounding at least a part of the cigarette 220. In addition, the heater may be made in a film shape having an electrical resistive pattern capable of generating heat when electricity is applied thereto. For example, the heater may include a substrate containing a material such as polyimide, and a conductive track disposed along a surface of the substrate. In another embodiment, the heater of the aerosol generation device 210 may have a planar structure adjacent to an upstream end of the cigarette 220.

Furthermore, the aerosol generation device 210 may individually heat a moisturizer accommodation portion of the cigarette 220 and a tobacco medium accommodation portion of the cigarette 220 by using a plurality of heaters. That is, the aerosol generation device 210 may include a first heater that heats the tobacco medium accommodation portion and a second heater that heats the moisturizer accommodation portion. In this case, operating temperatures of the first heater and the second heater may be different from each other.

By including moisturizer in a moisturizer accommodation portion of the cigarette 220, it is possible to reduce the amount of moisturizer contained in the tobacco medium accommodation portion or to remove the moisturizer from the tobacco medium accommodation portion. The moisturizer contains glycerin and so on. Glycerin has large molecular weight, and thus, it is necessary to heat the moisturizer at a high temperature to aerosolize the glycerin. That is, when the moisturizer is contained in the tobacco medium accommodation portion, the tobacco medium accommodation portion has to be heated at a high temperature to aerosolize materials contained in the moisturizer. By contrast, in the case where the moisturizer accommodation portion is included in the cigarette 220 as a separate segment, it is possible to reduce the amount of moisturizer contained in the tobacco medium accommodation portion or to remove the moisturizer from the tobacco medium accommodation portion. If the amount of moisturizer contained in the tobacco medium accommodation portion is reduced or the moisturizer is removed from the tobacco medium accommodation portion, it may be sufficient to heat the tobacco medium accommodation portion in a temperature range for aerosolizing nicotine.

In an embodiment, the first heater may heat the tobacco medium accommodation portion in a first temperature range so that nicotine contained in the tobacco medium accommodation portion is aerosolized. The first temperature range may be 150° C. to 200° C. In addition, the second heater may heat the moisturizer accommodation portion in a second temperature range higher than the first temperature range. The second temperature range may be 200° C. to 300° C., or preferably 200° C. to 250° C.

In an embodiment, the first heater may have a cylindrical structure. The second heater may have one of a cylindrical structure, a planar structure, an elongated structure, and a structure formed by a combination thereof. Details will be described with reference to FIGS. 4A to 4F.

The controller 213 serves to control overall functions for operating the aerosol generation device 210. The controller 213 may include a processor. For example, the processor may be a microcontroller unit (MCU), but is not limited thereto.

The controller 213 may be connected to a plurality of heaters to determine temperatures of the respective heaters, and may determine whether or not to adjust temperatures of the respective heaters based on the determined temperatures of the heaters. The controller 213 may adjust power supplied from the battery 214 to the plurality of heaters, based on the determination that the temperature of the heater is adjusted. For example, the controller 213 may adjust a magnitude or a cycle of a pulse voltage supplied from the battery 214 to the heater.

Figure 3:
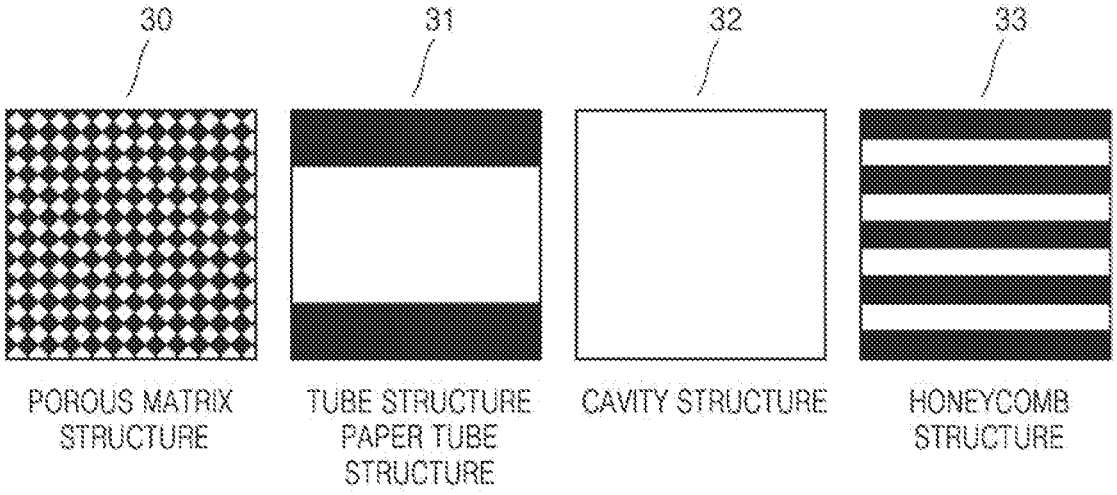
FIG. 3 shows example views illustrating cross sections of structures of a moisturizer accommodation portion according to one embodiment.

FIG. 3 is an example view illustrating a cross section of a moisturizer accommodation portion according to one embodiment.

Referring to FIG. 3, in an embodiment, the moisturizer accommodation portion may have a porous matrix structure 30. The porous matrix structure 30 may be formed of porous ceramic or cellulose acetate. In this case, the moisturizer accommodation portion of the porous matrix structure 30 may be impregnated with moisturizer.

In another embodiment, the moisturizer accommodation portion may have a tube structure (or paper tube) 31. The tube structure (or a paper tube) 31 is a shape including a hollow therein, and the hollow may be a path through which a heater is inserted into the moisturizer accommodation portion. The moisturizer accommodation portion of the tube structure 31 may be impregnated with the moisturizer, or the moisturizer accommodation portion of the paper tube 31 may be coated with the moisturizer.

In another embodiment, the moisturizer accommodation portion may have a cavity structure 32. The cavity structure 32 only includes an outer wrapper coated with moisturizer.

In another embodiment, the moisturizer accommodation portion may have a honeycomb structure 33. In the manufacturing process, the moisturizer accommodation portion may be made in the honeycomb structure 33 through processes of extrusion, compression, and injection. An empty space of the honeycomb structure 33 may be a path through which the heater is inserted into the moisturizer accommodation portion and may serve as an airflow path through which air introduced from an upstream end of the cigarette passes.

Furthermore, the moisturizer accommodation portion may be located at an upstream end or a downstream end of the tobacco medium accommodation portion. When the moisturizer accommodation portion is located at the upstream end of the tobacco medium accommodation portion, the moisturizer accommodation portion may have the porous matrix structure 30, the tube structure (or the paper tube) 31, the cavity structure 32, or the honeycomb structure 33. In addition, when the moisturizer accommodation portion is located at the downstream end of the tobacco medium accommodation portion, the moisturizer accommodation portion may have the porous matrix structure 30, the tube structure (or the paper tube) 31, or the cavity structure 32.

The moisturizer may be included in the moisturizer accommodation portion by being enclosed in a capsule or by being applied (or coated) to a film material. The capsule may have a spherical shape or a cylindrical shape. An outer film of the capsule may be made from agar, pectin, sodium alginate, carrageenan, gelatin, gum such as guar gum, and so on. In addition, a curing aid agent may be further used as a material for forming the outer film of the capsule. Here, for example, a calcium chloride group and so on may be used as a gelling aid agent. In addition, a plasticizer may be further used as the material for forming the outer film of the capsule. Here, glycerin and/or sorbitol may be used as the plasticizer. In addition, a coloring agent may be further used as the material for forming the outer film of the capsule 324. In addition, a film material may be polylactic acid (PLA), but is not limited thereto.

FIGS. 4A to 4F are views illustrating structures and arrangement of a plurality of heaters according to an embodiment.

Figure 4A:
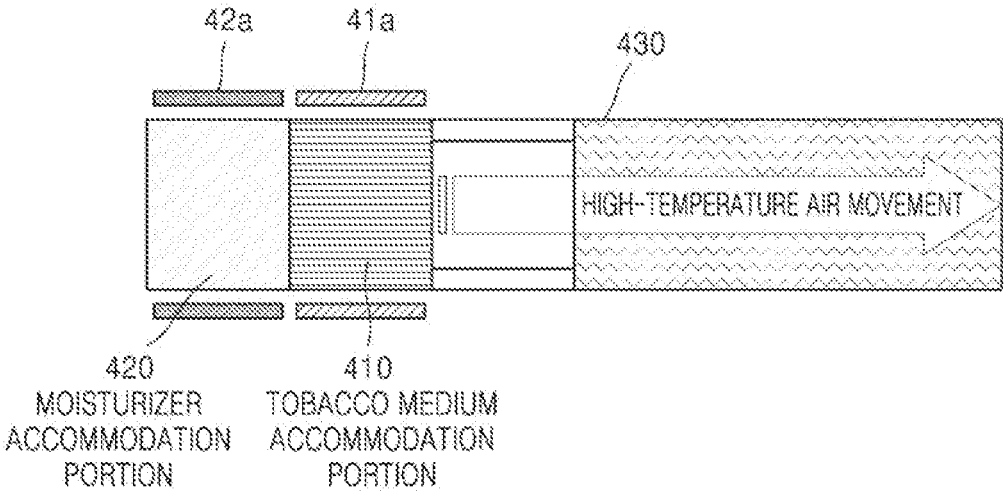
FIGS. 4A to 4F are views illustrating structures and arrangements of a plurality of heaters according to one embodiment.

Referring to FIG. 4A, a cigarette may include a tobacco medium accommodation portion 410, a moisturizer accommodation portion 420, and a filter 430. In an embodiment, the moisturizer accommodation portion 420 may be located at an upstream end of the tobacco medium accommodation portion 410.

Although not illustrated in FIG. 4A, a cigarette may be wrapped by at least one wrapper. In addition, the moisturizer accommodation portion 420 may further include a material (for example, aluminum foil) having waterproof, water-repellent (oil-repellent) and heat-resistant characteristics, which wraps the moisturizer accommodation portion. In this case, the aluminum foil may be located between the wrapper and the moisturizer accommodation portion 420.

The tobacco medium accommodation portion 410 may contain tobacco cuts, ethylene glycol, dipropylene glycol, diethylene glycol, triethylene glycol, tetraethylene glycol, and oleyl alcohol. In addition, the tobacco medium accommodation portion 410 may contain other additives such as savoring agents and/or organic acid.

The moisturizer accommodation portion 420 may contain moisturizer. The moisturizer may include glycerin, propylene glycol (PG) and water. In addition, the moisturizer may further contain at least one of ethylene glycol, dipropylene glycol, diethylene glycol, triethylene glycol, tetraethylene glycol, and oleyl alcohol.

The filter 430 may be composed of at least one segment and may include a tobacco filter wrapper wrapping the at least one segment. The filter 430 may include at least one of a tube filter, a cooling structure, and a recess filter, but is not limited thereto.

Since glycerin contained in the moisturizer has large molecular weight, the moisturizer has to be heated at a high temperature to aerosolize the glycerin. By including a moisturizer accommodation portion 420 containing a moisturizer in a cigarette, it is possible to reduce the amount of moisturizer contained in the tobacco medium accommodation portion 410 or to remove the moisturizer from the tobacco medium accommodation portion 410. Accordingly, a heating temperature of the tobacco medium accommodation portion 410 may be lowered. Furthermore, the moisturizer contained in the moisturizer accommodation portion 420 may maintain moisture in the aerosol generated during heating of a cigarette at an appropriate level to soften a unique taste of tobacco and enrich the amount of atomization.

The aerosol generation device may individually heat the tobacco medium accommodation portion 410 and the moisturizer accommodation portion 420 by using the first heater 41*a* and the second heater 42*a*. The moisturizer accommodation portion 420 is included in a cigarette as a separate segment, and thus, the amount of moisturizer contained in the tobacco medium accommodation portion 410 may be reduced or the moisturizer may be removed. The first heater 41*a* may heat the tobacco medium accommodation portion 410 in a first temperature range so that nicotine contained in the tobacco medium accommodation portion 410 is aerosolized. The first temperature range may be 150° C. to 200° C. In addition, the second heater 42*a* may heat a moisturizer accommodation portion in a second temperature range higher than the first temperature range. The second temperature range may be 200° C. to 300° C., or preferably 200° C. to 250° C. However, the first temperature range and the second temperature range are not limited thereto.

As illustrated in FIG. 4A, the first heater 41*a* and the second heater 42*a* may have a cylindrical structure. The first heater 41*a* heats the outside of the tobacco medium accommodation portion 410 by surrounding at least a part of the tobacco medium accommodation portion 410, and the second heater 42*a* heats the outside of the moisturizer accommodation portion 420 by surrounding at least a part of the moisturizer accommodation portion 420.

The moisturizer accommodation portion 420 is located at an upstream end of the tobacco medium accommodation portion 410, and thus, when a user inhales with a cigarette, air introduced from the upstream end of the cigarette passes through the moisturizer accommodation portion 420 to be heated by the second heater 42*a*, and thereby, the moisturizer (for example, glycerin) is aerosolized. In addition, the air passing through the moisturizer accommodation portion 420 is heated by the first heater 41*a* while passing through the tobacco medium accommodation portion 410, and thus, a tobacco medium (for example, nicotine) is additionally aerosolized. At this time, the air flowing into the tobacco medium accommodation portion 410 is hot air heated by the second heater 42*a*, and thus, the tobacco medium accommodation portion 410 absorbs heat from not only the first heater 41*a* but also the hot air to perform aerosolization.

Hereinafter, description overlapping the content of FIG. 4A will be omitted.

Figure 4B:
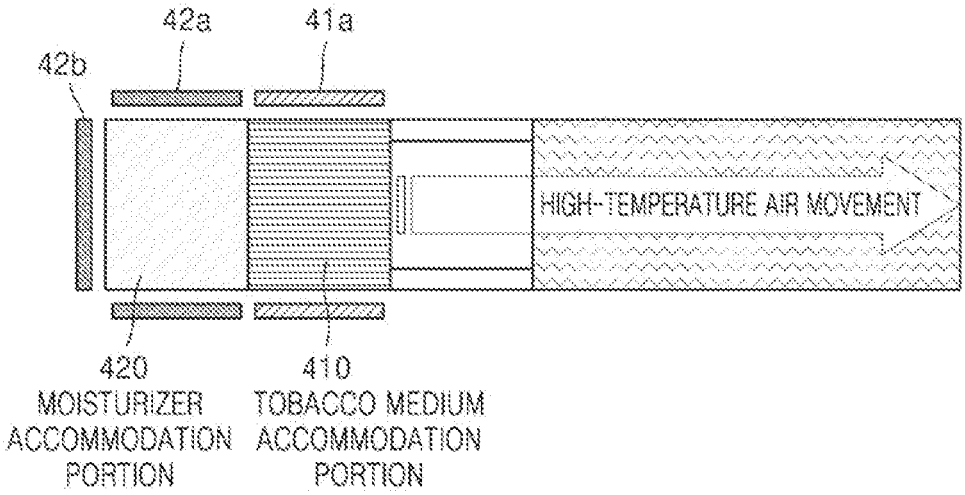

As illustrated in FIG. 4B, the first heater 41*a* may have a cylindrical structure. The second heater 42*a* and 42*b* may have a cylindrical structure and a planar structure. The first heater 41*a* may heat the outside of the tobacco medium accommodation portion 410 by surrounding at least a part of the tobacco medium accommodation portion 410. The second heater 42*a* of a cylindrical structure may heat the outside of the moisturizer accommodation portion 420 by surrounding at least a part of the moisturizer accommodation portion 420, and the second heater 42*b* of a planar structure may be located at an upstream end of the moisturizer accommodation portion 420 to heat an upstream end of the moisturizer accommodation portion 420. Furthermore, the second heater 42*b* of a planar structure may be in contact with the upstream end of the moisturizer accommodation portion 420 or may be spaced apart by a predetermined distance from the upstream end of the moisturizer accommodation portion 420.

Figure 4C:
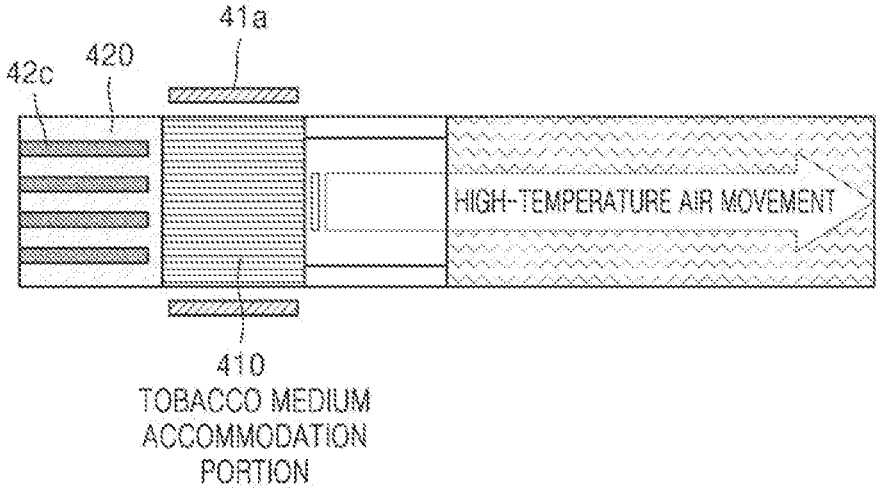

As illustrated in FIG. 4C, the first heater 41*a* may have a cylindrical structure, and the second heater 42*c* may have an elongated structure. The first heater 41*a* may heat the outside of the tobacco medium accommodation portion 410 by surrounding at least a part of the tobacco medium accommodation portion 410. The second heater 42*c* may heat the inside of the moisturizer accommodation portion 420 by being inserted into the moisturizer accommodation portion 420.

Figure 4D:
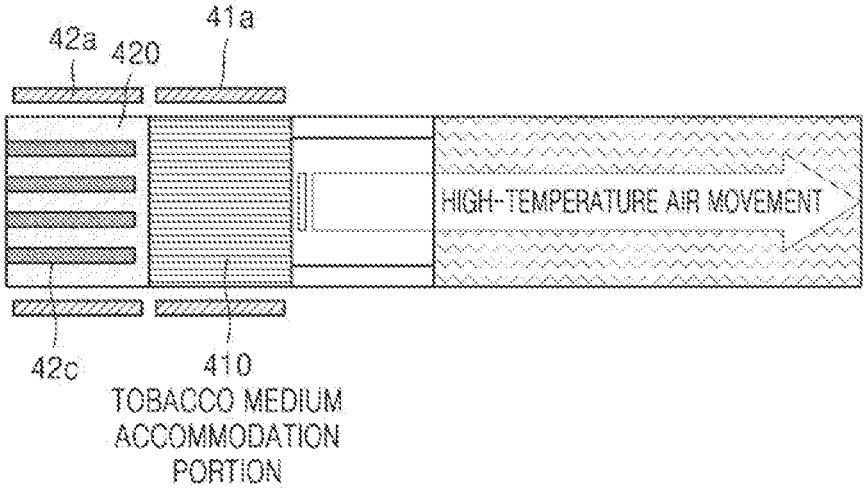

As illustrated in FIG. 4D, the first heater 41*a* may have a cylindrical structure. The second heater 42*a* and 42*c* may have a cylindrical structure and an elongated structure. The first heater 41*a* may heat the outside of the tobacco medium accommodation portion 410 by surrounding at least a part of the tobacco medium accommodation portion 410. The second heater 42*a* of a cylindrical structure may heat the outside of the moisturizer accommodation portion 420 by surrounding at least a part of the moisturizer accommodation portion 420, and the second heater 42*c* of an elongated structure may heat the inside of the moisturizer accommodation portion 420 by being inserted into the moisturizer accommodation portion 420.

Figure 4E:
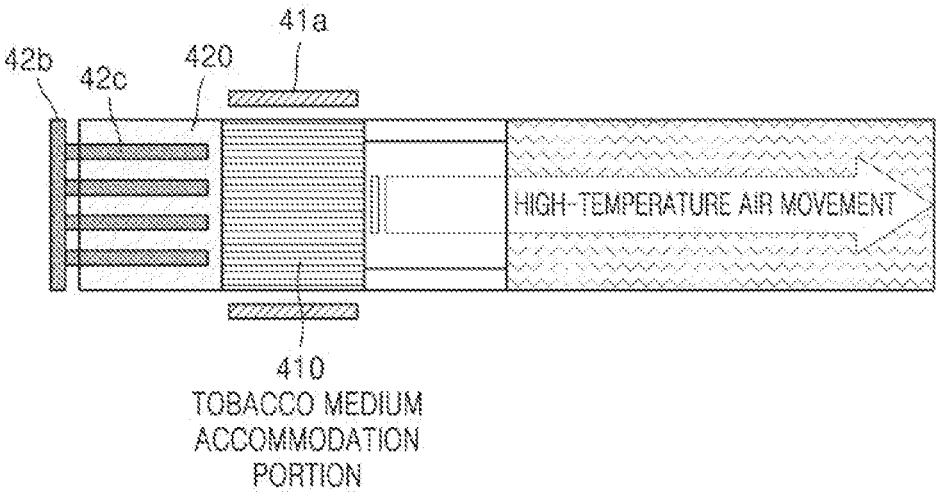

As illustrated in FIG. 4E, the first heater 41*a* may have a cylindrical structure. The second heater 42*b* and 42*c* may have a planar structure and an elongated structure. The first heater 41*a* may heat the outside of the tobacco medium accommodation portion 410 by surrounding at least a part of the tobacco medium accommodation portion 410. The second heater 42*b* of a planar structure may heat an upstream end of the moisturizer accommodation portion 420 by being located at the upstream end of the moisturizer accommodation portion 420, and the second heater 42*c* of an elongated structure may heat the inside of the moisturizer accommodation portion 420 by being inserted into the inside of the moisturizer accommodation portion 420. Furthermore, the second heater 42*b* of a planar structure may be in contact with the upstream end of the moisturizer accommodation portion 420 or may be spaced apart by a predetermined distance from the upstream end. In addition, the second heater 42*b* of a planar structure may be coupled to the second heater 42*c* of an elongated structure.

Figure 4F:
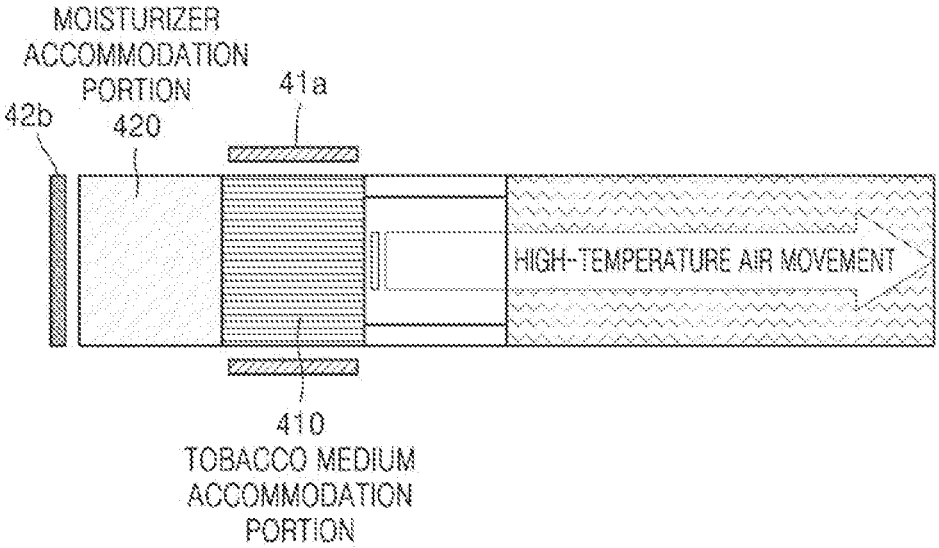

As illustrated in FIG. 4F, the first heater 41*a* may have a cylindrical structure, and the second heater 42*b* may have a planar structure. The first heater 41*a* may heat the outside of the tobacco medium accommodation portion 410 by surrounding at least a part of the tobacco medium accommodation portion 410. The second heater 42*b* may heat an upstream end of the moisturizer accommodation portion 420 by being located at the upstream end of the moisturizer accommodation portion 420. The second heater 42*b* of a planar structure may be in contact with the upstream end of the moisturizer accommodation portion 420 or may be spaced apart by a predetermined distance from the upstream end of the moisturizer accommodation portion 420.

Furthermore, the moisturizer accommodation portion 420 may have any one of a porous matrix structure, a tube structure, a paper tube, a cavity structure, or a honeycomb structure. In addition, the moisturizer may be surrounded by a capsule or film material and included in the moisturizer accommodation portion 420.

Figure 5A:
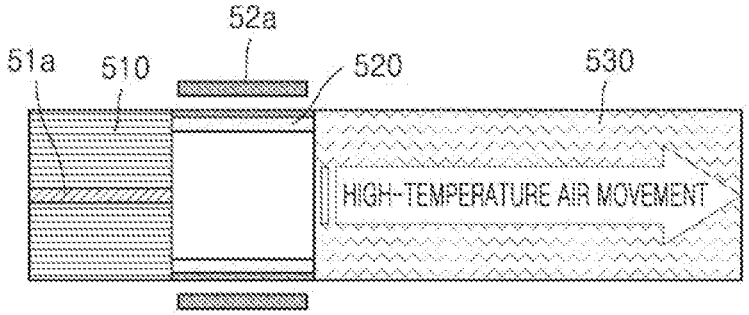
FIGS. 5A to 5B are views illustrating structures and arrangements of a plurality of heaters according to one embodiment.
Figure 5B:
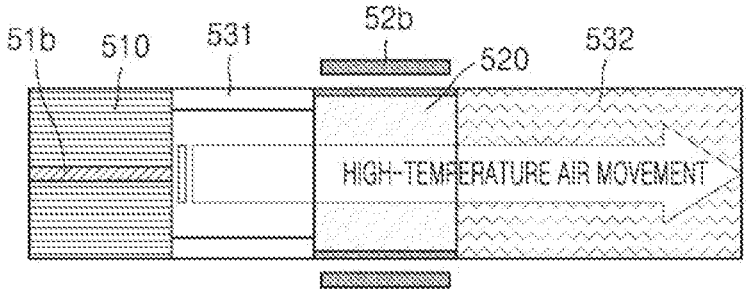

FIGS. 5A to 5B are views illustrating structures and arrangement of a plurality of heaters according to an embodiment.

Hereinafter, description overlapping the content of FIGS. 4A to 4F will be omitted.

Referring to FIG. 5A, a cigarette may include a tobacco medium accommodation portion 510, a moisturizer accommodation portion 520, and a filter 530. In an embodiment, the moisturizer accommodation portion 520 may be located at a downstream end of the tobacco medium accommodation portion 510.

The aerosol generation device may individually heat the tobacco medium accommodation portion 510 and the moisturizer accommodation portion 520 by using a first heater 51*a* and a second heater 52*a*. The first heater 51*a* may heat the tobacco medium accommodation portion 510 in a first temperature range so that nicotine contained in the tobacco medium accommodation portion 510 is aerosolized. The first temperature range may be 150° C. to 200° C. In addition, the second heater 52*a* may heat the moisturizer accommodation portion in a second temperature range higher than the first temperature range. The second temperature range may be 200° C. to 300° C., or preferably 200° C. to 250° C. However, the first temperature range and the second temperature range are not limited thereto.

As illustrated in FIG. 5A, the first heater 51*a* may have an elongated structure, and the second heater 42*a* may have a cylindrical structure. The first heater 51*a* may heat the inside of the tobacco medium accommodation portion 410 by being inserted into the tobacco medium accommodation portion 410, and the second heater 42*a* may heat the outside of the moisturizer accommodation portion 420 by surrounding at least a part of the moisturizer accommodation portion 420.

Referring to FIG. 5B, a cigarette may include the tobacco medium accommodation portion 510, the moisturizer accommodation portion 520, a first filter 531, and a second filter 532. In an embodiment, when the moisturizer accommodation portion 520 is located at a downstream end of the tobacco medium accommodation portion 510, the second filter 532 may be located between the tobacco medium accommodation portion 510 and the moisturizer accommodation portion 520. The second filter 532 may include at least one of a tube filter, a cooling structure, and a recess filter, but is not limited thereto.

As illustrated in FIG. 5B, the first heater 51*b* may have an elongated structure, and the second heater 52*b* may have a cylindrical structure. The first heater 51*b* may heat the inside of the tobacco medium accommodation portion 510 by being inserted into the tobacco medium accommodation portion 510, and the second heater 52*b* may heat the outside of the moisturizer accommodation portion 520 by surrounding at least a part of the moisturizer accommodation portion 520.

Furthermore, the first heater 51*a* and 51*b* may have one of a cylindrical structure in which the heater surrounds at least a part of the tobacco medium accommodation portion 510, a planar structure in which the heater is located at an upstream end of a cigarette, an elongated structure in which the heater is inserted into the tobacco medium accommodation portion 510, and a structure formed by a combination thereof.

Those of ordinary skill in the art related to the present embodiments may understand that various changes in form and details may be made therein without departing from the scope of the characteristics described above. The disclosed methods should be considered in a descriptive sense only and not for purposes of limitation. The scope of the present disclosure is represented in the claims rather than the foregoing description, and all differences within the equivalent range should be interpreted as being included in the present disclosure.

What is claimed is:

1. A cigarette comprising:

a tobacco medium accommodation portion; and a moisturizer accommodation portion located at an upstream end of the tobacco medium accommodation portion, wherein the moisturizer accommodation portion includes a cellulose-based material impregnated with a moisturizer.

2. The cigarette of claim 1, wherein the moisturizer accommodation portion is wrapped by wrappers and predetermined materials, wherein the predetermined materials have one of waterproof characteristic, water-repellent characteristic, oil-repellent characteristic, and heat-resistant characteristic.

3. The cigarette of claim 2,
wherein the predetermined materials include aluminum foil.

4. The cigarette of claim 2,
wherein the moisturizer accommodation portion includes glycerin and propylene glycol, and optionally includes nicotine.

5. The cigarette of claim 1,
wherein the tobacco medium accommodation portion is filled with tobacco cut.

6. The cigarette of claim 1,
wherein the tobacco medium accommodation portion is filled with a mixture of tobacco cut and reconstituted tobacco.

7. The cigarette of claim 1,
wherein the tobacco medium accommodation portion includes savoring agents.

8. The cigarette of claim 1,
wherein the cigarette further comprises:
a filter located at an downstream end of the moisturizer accommodation portion; and
wherein the filter is made of paper tube.

9. The cigarette of claim 8,
wherein the filter includes a structure made of polylactic acid.

10. An aerosol generation system comprising:
a cigarette including:
a tobacco medium accommodation portion; and
a moisturizer accommodation portion located at an upstream end of the tobacco medium accommodation portion; and
an aerosol generation device including:
an elongated cavity configured to accommodate the cigarette; and
a heater partially surrounding the tobacco medium accommodation portion and the moisturizer accommodation portion,
wherein the moisturizer accommodation portion includes a cellulose-based material impregnated with a moisturizer.

11. The aerosol generation system of claim 10,
wherein the tobacco medium accommodation portion and the moisturizer accommodation portion are heated to different temperatures.

* * * * *